US008488983B2

(12) United States Patent
Hochwind et al.

(10) Patent No.: US 8,488,983 B2
(45) Date of Patent: Jul. 16, 2013

(54) METHOD AND DEVICE FOR PROCESSING A MEASURED SIGNAL FOR RECORDING A PROPERTY OF A TONER MARK

(75) Inventors: Bernhard Hochwind, München (DE); Markus Jeschonek, Oberding (DE)

(73) Assignee: Océ Printing Systems GmbH, Poing (DE)

( * ) Notice: Subject to any disclaimer, the term of this patent is extended or adjusted under 35 U.S.C. 154(b) by 520 days.

(21) Appl. No.: 12/522,613

(22) PCT Filed: Jan. 11, 2008

(86) PCT No.: PCT/EP2008/050266
§ 371 (c)(1),
(2), (4) Date: Jul. 9, 2009

(87) PCT Pub. No.: WO2008/084088
PCT Pub. Date: Jul. 17, 2008

(65) Prior Publication Data

US 2010/0117662 A1 May 13, 2010

(30) Foreign Application Priority Data

Jan. 11, 2007 (DE) ..... 10 2007 001 687

(51) Int. Cl.
*G03G 15/00* (2006.01)
*G03G 15/01* (2006.01)

(52) U.S. Cl.
USPC ..... 399/49; 399/40; 399/72

(58) Field of Classification Search
USPC ..... 399/49
See application file for complete search history.

(56) References Cited

U.S. PATENT DOCUMENTS

| | | | | |
|---|---|---|---|---|
| 5,424,809 | A | 6/1995 | Sawayama et al. | |
| 5,752,126 | A * | 5/1998 | Muramatsu | 399/44 |
| 5,784,667 | A | 7/1998 | Mestha et al. | |
| 6,215,968 | B1 * | 4/2001 | Uehara et al. | 399/49 |
| 6,771,913 | B2 | 8/2004 | Jeschonek et al. | |
| 7,016,620 | B2 | 3/2006 | Maess et al. | |

(Continued)

FOREIGN PATENT DOCUMENTS

| | | |
|---|---|---|
| DE | 196 43 611 A1 | 4/1998 |
| DE | 101 36 259 A1 | 2/2003 |

(Continued)

OTHER PUBLICATIONS

Int'l Search Report in PCT/EP2008/050266 dated Jun. 6, 2008.*

(Continued)

*Primary Examiner* — Walter L Lindsay, Jr.
*Assistant Examiner* — David Bolduc
(74) *Attorney, Agent, or Firm* — Schiff Hardin LLP

(57) ABSTRACT

In a method or system for processing a measurement signal to detect a property of a toner mark, the toner mark is generated with aid of an image generation device. The toner mark is detected with aid of a measurement unit in that sample values determined by the measurement unit at sample points in time are output as the measurement signal for detecting the property of the toner mark. A function is determined to describe at least one part of a signal curve of the measurement signal on a basis of at least one part of the output sample values. At least one extreme value of the function is determined.

11 Claims, 6 Drawing Sheets

U.S. PATENT DOCUMENTS

| | | | | |
|---|---|---|---|---|
| 7,068,957 | B2 * | 6/2006 | Shimura et al. | 399/49 |
| 7,072,597 | B2 * | 7/2006 | Shimura et al. | 399/49 |
| 7,120,369 | B2 * | 10/2006 | Hamby et al. | 399/49 |
| 7,133,623 | B2 * | 11/2006 | Yoshida | 399/49 |
| 7,382,507 | B2 * | 6/2008 | Wu | 358/523 |
| 7,911,652 | B2 * | 3/2011 | Goodman et al. | 358/3.26 |
| 2002/0159791 | A1 * | 10/2002 | Chen et al. | 399/167 |
| 2003/0058460 | A1 | 3/2003 | Denton et al. | |
| 2003/0091355 | A1 * | 5/2003 | Jeschonek et al. | 399/49 |
| 2004/0057739 | A1 * | 3/2004 | Shimura | 399/49 |
| 2004/0253013 | A1 * | 12/2004 | Furukawa | 399/49 |
| 2005/0163519 | A1 * | 7/2005 | Takahashi | 399/49 |
| 2005/0265739 | A1 * | 12/2005 | Hamby et al. | 399/49 |
| 2006/0233559 | A1 * | 10/2006 | Sugita et al. | 399/27 |
| 2007/0019975 | A1 * | 1/2007 | Komiya | 399/49 |
| 2007/0019976 | A1 * | 1/2007 | Watanabe et al. | 399/49 |
| 2008/0112717 | A1 * | 5/2008 | Zaitsu et al. | 399/48 |
| 2008/0112718 | A1 * | 5/2008 | Akashi et al. | 399/49 |

FOREIGN PATENT DOCUMENTS

| | | | |
|---|---|---|---|
| DE | 101 51 703 | A1 | 5/2003 |
| GB | 2 244 350 | A | 11/1991 |
| JP | 2000251054 | A * | 9/2000 |
| JP | 2003/035978 | | 2/2003 |

OTHER PUBLICATIONS

Int'l Preliminary Report on Patentability in PCT/EP2008/050266 dated Aug. 13, 2009.*

Machine (Google) translation of JP 2000251054.*

Press, W. et al.: Numerical Recipies in C, The Art of Scientific Computing, 2nd Edition, Cambridge University Press (1992), ISBN 0521-43108-5, p. 105-116, 394-405 and 656-661.

"Digital Printing—Technology and printing techniques of Oce digital printing presses", 9, Auflage, Feb. 2005; ISBN 3-00-001081-5, p. 222 Figure 8.22.

* cited by examiner

METHOD AND DEVICE FOR PROCESSING A MEASURED SIGNAL FOR RECORDING A PROPERTY OF A TONER MARK

BACKGROUND

The preferred embodiment concerns a method and a device for processing a measurement signal to detect a property of a toner mark, in which method the toner mark is generated with the aid of an image generation device. The toner mark is detected with the aid of a measurement arrangement in that the measurement arrangement outputs determined sample values as a measurement signal at sample points in time.

In electrographic high-capacity printers for printing of single sheets or web-shaped substrate material with printing capacities of >50 pages DIN A4/minute, up to a few 100 sheets of DIN A4/minute, as well as print and image generation speeds of up to 2 m/sec at present, large quantities of toner material can be consumed within a relatively short time to generate the print images. In such electrographic high-capacity printers, inking rules are used in order to keep the degree of inking of print images constant. Electrographic image generation methods comprise, for example, electrographic, magnetographic and ionographic image generation methods.

A method and a device to control a printing process are known from the document DE 101 36 259 A1 and the parallel U.S. Pat. No. 7,016,620 B2, in which printing process a toner mark is generated on an intermediate carrier by a character generator with a lower energy than the energy applied to generate other print images, such that the color density of the inked toner mark is reduced. A reflection sensor determines the color density of the inked toner mark, wherein the toner concentration in a developer station is set depending on the determined color density.

Measurement arrangements to determine the layer thickness of a toner mark with the aid of capacitive sensors are also known from the document DE 101 51 703 A1 and the parallel U.S. Pat. No. 6,771,913 B2. The cited documents are herewith incorporated by reference into the present Specification.

In order to improve the half-tone reproduction as well as the quality of multicolor printing, in which multiple color separations of different colors are printed atop one another, it is necessary to also detect small toner quantities (in particular of toner marks that are not inked over the entire area). The actual printed density or the average layer thickness of the toner mark is advantageously already measured at the photoconductor with the aid of a measurement device and thus is immediately measured after the development of a latent print image into a toner image. The optical density of a full-tone mark and/or the point size of raster points inked with toner can be regulated with the aid of the measurement result. Given use of a capacitive sensor to determine the layer thickness of the toner particle layer of the toner mark, the dielectricity or relative permittivity of the toner with whose toner particles the toner mark is inked is that quantity on which the measurement method is based.

In addition to toners with the standard colors cyan (C), magenta (M), yellow (Y) and black (K), special colors (in particular also customer-specific special colors) can be used in high-capacity printers, which special colors exhibit a dielectricity deviating from that of standard colors depending on the material composition. In particular given low dielectricities and/or small toner quantities of the toner mark to be detected by a capacitive sensor, only capacity changes in the femtofarad range can be determined by a capacitive sensor, whereby only low signal strengths are output to the capacitive sensor. Very slight perturbations can thereby severely distort the measurement result. An inking and/or point size regulation that is required for the image generation process can thereby be severely plagued with errors, whereby the quality of the image generation process can no longer be ensured.

SUMMARY

It is an object to specify a method and a device to process a measurement signal to detect a property of a toner mark, in which method and device errors in the measurement value detection are reduced.

In a method or system for processing a measurement signal to detect a property of a toner mark, the toner mark is generated with aid of an image generation device. The toner mark is detected with the of a measurement unit in that sample values determined by the measurement unit at sample points in time are output as the measurement signal for detecting the property of the toner mark. A function is determined to describe at least one part of a signal curve of the measurement signal on a basis of at least one part of the output sample values. At least one extreme value of the function is determined.

DESCRIPTION OF THE PREFERRED EMBODIMENT

Figure 1A:
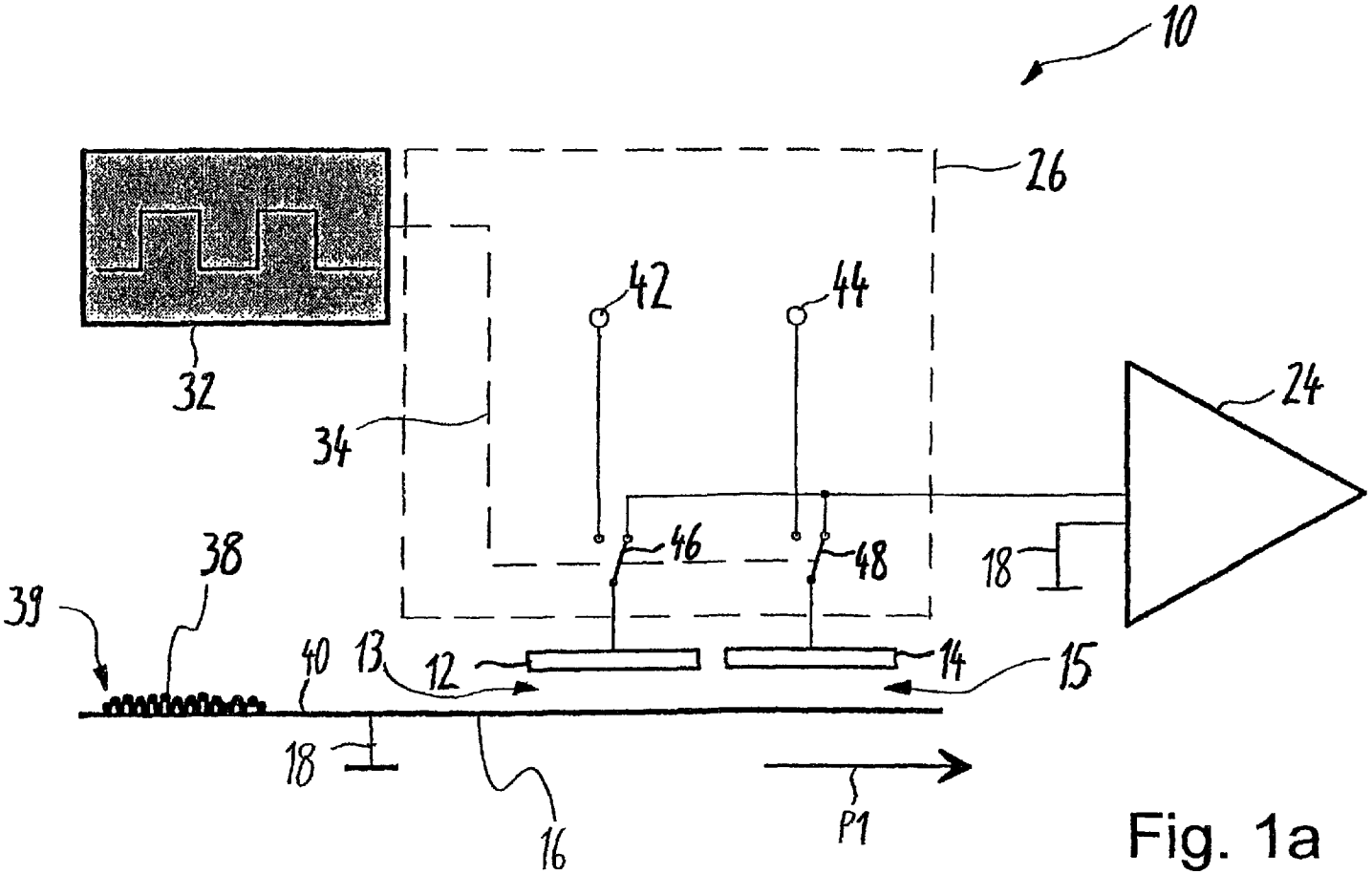
FIG. 1*a* is a schematic representation of the design of a device to determine the areal coverage of a toner mark with the aid of the capacitive measurement method.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and method, and such further applications of the principles of the invention as illustrated as would normally occur to one skilled in the art to which the invention relates are included.

In the method of the preferred embodiment the toner mark is detected with the aid of a measurement arrangement in that sample values are determined by the measurement arrangement at sample points in time and are output as a measurement signal. A function to describe an (advantageously continuous) signal curve of the measurement is determined on the basis of at least a portion of the output sample values. The signal curve is advantageously determined for a time period that is comprised by a portion of the sample values. At least one extreme value of the function is also determined.

Via this method it is achieved that, starting from the detected sample values, a function is determined via which individual, incorrect sample values do not lead to an unusable measurement result. Rather, a probable actual signal curve that would be determined without parasitic inductions is determined via the function. If an extreme value (in particular a maximum value and/or a minimum value) is determined by this function, an actual maximum and/or minimum of the measurement signal can thereby also be determined in a simple manner when the signal curve of the measurement signal exhibits additional or other extreme values in the relevant time period due to perturbations, in particular also when a significantly larger sample value than the maximum value and/or a significantly smaller sample value than the minimum value has occurred in the signal curve.

The device according to the preferred embodiment for processing a measurement signal to detect a property of a toner mark possess the same advantages as the method of the preferred embodiment.

A measurement arrangement 10 to detect a toner mark 39 generated as a toner particle layer 38 with the aid of an electrographic image generation process is shown in FIG. 1*a*. This measurement arrangement 10 is used in an electrographic printer or copier to detect the inking of the print image and/or the point size of raster points inked with toner particles. The average layer thickness of a toner mark 29 present in the detection region of this measurement arrangement 10 is detected with the aid of the measurement arrangement 10.

The toner mark 39 has a homogeneous print image with a uniform inking pattern, with an inking over its entire surface or with an inking not over its entire surface. The toner layer 38 of the toner mark 39 has been generated (with the aid of a character generator, for example an LED character generator or a laser character generator) as a latent raster image in the form of a latent image on a photoconductor belt 16 charged with the aid of a charging device, for example a corotron device. This latent raster image has subsequently been developed with the aid of a developer unit (not shown) in that the toner particles provided by the developer unit have been used to ink the latent raster image.

The development of the latent raster image with toner particles advantageously occurs with the aid of what is known as a tribo-jump development, in which electrically charged toner particles provided by the developer unit are transferred from the developer unit to regions to be inked with these via the force exerted on the toner particles by an electrical field in the direction of the regions of the latent raster image that are to be inked. The voltage required to generate the electrical field is also designated as a bias voltage. It is particularly advantageous when a layer of toner particles with an essentially constant layer thickness is provided by the developer station, which layer is then transferred only onto the regions that are to be inked via the bias voltage. The intensity of the inking effect can thus be controlled via the adjustment of a suitable bias voltage.

An additional electrical field that exerts a force on the toner particles in the direction of the developer station so that no toner particles are transferred from the developer station to the regions of the photoconductor belt 16 that are not to be inked is generated by the bias voltage between the regions of the latent raster image that are not to be inked and the developer station. A schematic of a tribo-jump developer station is shown and briefly described on Page 222 in FIG. 8.22 in the document "Digital Printing—Technology and printing techniques of Océ digital printing presses", 9th edition, February 2005; ISBN 3-00-001081-5.

The photoconductor belt 16 is a continuous revolving belt that is directed with the aid of deflection rollers (not shown). The photoconductor belt 16 contains electrically conductive components that are connected in an electrically conductive manner with a reference potential 18. The toner layer 38 of the generated toner marks 39 as well as toner layers of print images are arranged on the generated surface 40 of the photoconductor belt 16. A first electrode 12 and a second electrode 14 (which are designed in the exemplary embodiment as plate-shaped electrodes 12, 14) are arranged parallel to the generated surface 40. The effective surfaces of the electrodes 12, 14 and the photoconductor belt 16 serving as a counter-electrode are facing towards one another, wherein the first electrode 12 and the second electrode 14 advantageously have the same effective surface. The photoconductor belt 16 is thus a counter-electrode to the electrodes 12, 14, which counter-electrode is connected with the reference potential 18. The first electrode 12 and the counter-electrodes form a first capacitor 13, and the second electrode 14 and the counter-electrode form a second capacitor 15. Given the same effective surface of the electrodes 12, 14 and an identical spacing of the electrodes 12, 14 from the counter-electrode, the first capacitor 13 and the second capacitor 15 have the same capacitance when no toner layer 38 and no toner residues or the same toner quantity are present between the photoconductor belt 16. The distance between photoconductor belt 16 and the electrodes 14, 16 is preset to a value in the range from 0.2 mm to 10 mm. This distance is advantageously approximately 1 mm.

In a first switching state, a switching unit 26 is provided in order to connect (with the aid of crossover switches 46, 48) the electrode 12 with a voltage source 42 that is positive relative to the reference potential 18 and the electrode 14 with a voltage source 44 that is negative relative to the reference potential 18. The magnitudes of the voltages provided by the voltage sources are advantageously the same. For example, the positive voltage emitted by the voltage source 42 is, for example, +10 V), and negative voltage emitted by the voltage source 44 is for example, −10 V relative to the reference potential 18 (for example 0 V).

In a second switching state, the switching unit 26 separates the connections to the voltage sources 42, 44 with the aid of the crossover switches 46, 48, shorts the two electrodes 12, 14, and thereby establishes a connection to the evaluation unit 24. The charge difference of the capacitors 13, 15 is thus determined and supplied to the evaluation unit 24. A sampling of a measurement value generated by the charge difference occurs via the crossover switching in the second switching state. A clock signal 34 of a clock pulse emitter 32 is supplied to the switching unit 26, which clock signal 34 is advantageously a square wave signal with constant pulse-pause ratio. The clock frequency of the clock signal 34, and thus the switching frequency of the switching unit 26 to switch over between the two switching states (or of the crossover switches 46, 48) advantageously lies in a range between 300 Hz and 1 MHz.

The clock pulse emitter 32 is in particular a component of a control unit (not shown) to evaluate the sensor signal output by the measurement arrangement 10, wherein the clock signal 34 causes a change of the switching state of the crossover switches 46, 48 in the switching unit. The switching over of the capacitors as a result of the switching states is also designated as a switched capacitor technique. Additional details regarding the design and further embodiments of the measurement arrangement 10 are known from the document DE 101 51 703 A1 and the parallel U.S. Pat. No. 6,771,913 B2, the content of which is herewith incorporated by reference into the present specification.

For example, the evaluation unit 24 can be a filter and have a downstream amplifier. A measurement signal generated by the evaluation unit 24 is supplied to the control unit for further processing. If, as already mentioned, a filter in the evaluation unit 24 is used for evaluation, the filter type as well as the required filter parameters of the filter can thus be preset depending on the switching frequency and the resulting sample frequency.

If the toner particle layer 38 of the toner mark 39 is transported through the air gaps of the electrodes 12, 16 and 14, 16 on the photoconductor belt 16 in the direction of the arrow P1, the capacitance difference of the two capacitors 13, 15 is thus determined at every sample point in time or at every switch-over point in time in the second operating state. The same capacitances of the capacitors 13, 15 without toner marks in the detection region of the measurement arrangement 10 change when toner particles are present in the region between the respective electrodes 12, 14 and the counter-electrode since the toner particles have a different relative permittivity than the air that is otherwise exclusively present between the electrodes 12/16, 14/16.

The layer thickness of the toner particle layer that would be present on the active surface of the respective capacitor 13, 15 given a uniform distribution of the toner particles present in the respective capacitor 13, 15 can be determined from the change of the capacitance of at least one of the capacitors 13, 15. The average layer thickness of the toner particles present in the detection region of the respective capacitor 13, 15 is thus determined since a toner mark 39 that covers half of the effective surface of a capacitor 13, 15 and has a first layer thickness cannot be differentiated from a second toner mark 39 that covers the entire active surface of the capacitor 13, 15 and has half the layer thickness of the first layer thickness.

However, given correspondingly elaborate evaluation and a sufficient number of samples with regard to the transport speed to transport the photoconductor belt 16 in the direction of the arrow P1, the exact layer thickness curve of a toner mark can be determined in the transport direction of the photoconductor belt 16 using the capacitance curve.

The capacitance change of the capacitors 13, 15 as a result of the toner particles of the toner layer 38 that are present in the region of the capacitors 13, 15 on the photoconductor belt 16 results from the change of the dielectric, i.e. from the change of the coated dielectric of the respective capacitor 13, 15 upon transport of the toner layer 38 through between the respective electrodes 12, 14 and the counter-electrodes of the respective capacitor 13, 15.

The charge difference generated due to the shorting of the electrodes 12, 14 in the second switching state depending on the capacitances of the capacitors 13, 15 at the sampling point in time is additionally processed with the aid of the evaluation circuit 24 and is advantageously supplied to the control unit. According to the preferred embodiment, given a known layer thickness the control unit can also determine the areal coverage of the respective toner mark 29 when the print image of the respective toner mark 39 is not entirely inked with toner particles. In particular given toner marks 39 with multiple band-shaped or linear regions of a print image that are inked with toner particles and arranged in parallel, the area of the toner mark 39 inked with toner particles and/or the area of the toner mark 39 that is not inked with toner particles can be determined or established in the region of the respective capacitor 13, 15 with the aid of such a capacitor 13, 15 given a known, constant layer thickness. Given toner marks that are inked over their entire surface with toner particles, the layer thickness of the toner particle layer (and thereby the optical density of the toner mark) can be determined or established. The inked surface of the toner mark 39 can be determined in the same manner when the toner mark 39 has additional or alternative point-shaped inked regions. These point-shaped inked regions can comprise both individual pixels and regions composed of multiple pixels, what are known as superpixels.

It is advantageous to supply a toner mark that is inked over its entire surface and a toner mark that is not inked over its entire surface to the arrangement 10 in arbitrary order, the regions of which toner marks that are to be inked being respectively inked with the same layer thickness, whereby the ratio of the toner quantity of the toner mark that is not inked over its entire surface can be determined depending on the toner quantity of the toner mark that is inked over its entire surface. The relative inking or the percentile area of the partially inked toner mark can thereby be determined in relation to the toner mark inked over its entire surface.

Figure 1B:
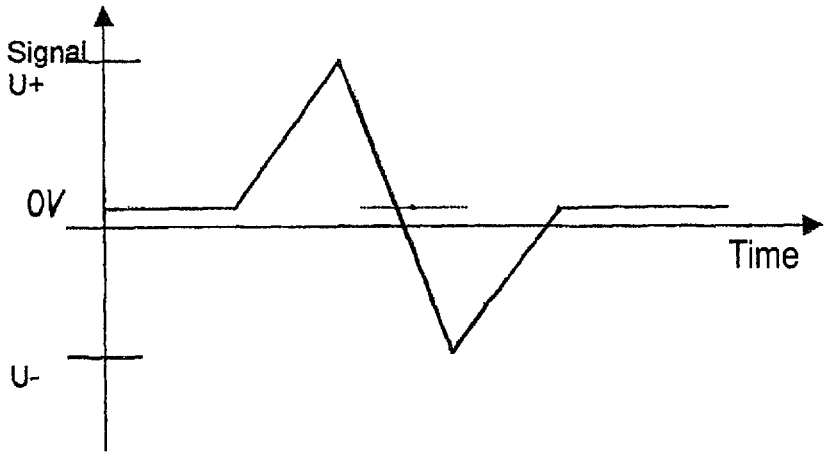
FIG. 1*b* is a voltage-time diagram with the theoretical curve of a measurement signal generated by the device according to FIG. 1*a* upon implementation of a toner mark.

A time-voltage diagram in which the theoretical signal curve of a measurement signal output by the measurement arrangement according to FIG. 1*a* is shown in FIG. 1*b*. For simplification, a continuous signal curve is shown in FIG. 1*b*. The actual signal curve used for the evaluation is composed of a plurality of sample values from which an analog signal is advantageously generated after filtering and amplification by the evaluation unit 24. The sample rate for determination of these sample values is derived from the clock signal 34 output by the clock pulse emitter 32 in order to avoid fluctuations. The signal curve is sampled with the aid of the evaluation arrangement 24 upon passage of the toner mark 39 through the capacitors 13, 15, while the photoconductor belt 16 is directed through the capacitors 13, 15 with a constant speed (for example in the range from 0.2 to 3 m/s) between the electrodes 12, 14 and the photoconductor belt 16.

The relative permittivity of toner is greater than the relative permittivity of air. The capacitance of the capacitors 13, 15 is thereby increased upon passage of the toner mark 39 through these capacitors 13, 15. The toner layer 38 of the toner mark 39 is transported into the first capacitor 13 with the aid of the photoconductor belt 16. The capacitance of the first capacitor 13 is thereby increased. The capacitance of the first capacitor 13 thereby increases until the toner layer 38 of the toner mark 39 covers the greatest possible active area of the first capacitor 13. The signal shown in FIG. 1*b* thereby rises with increasing capacitance of the first capacitor 13, from 0 V up to a maximum U+. Due to the continuous actuation of the photoconductor belt 16, the toner layer 38 of the toner mark 29 is transported further into the capacitor 15 and simultaneously out of the first capacitor 13. During this time period the capacitance of the second capacitor 15 increases to the same extent that the capacitance of the first capacitor 13 decreases. In terms of magnitude the negative slope of the output signal of the evaluation arrangement 24 is thereby twice as large as if the toner layer 38 of the toner mark 39 were simply driven out of the first capacitor 13 or if the toner layer 38 of the toner mark 39 were simply driven into the second capacitor 15.

If the toner layer 38 has been completely transported out of the first capacitor 13, and if this toner layer 38 covers the greatest possible active surface of the second capacitor 15, the evaluation arrangement 24 outputs a voltage signal U−. The toner layer 38 is subsequently driven out of the second capacitor 15, whereby the voltage signal output by the evaluation arrangement 24 decreases continuously from the value U– to 0. This slope occurs up to the point in time at which the toner layer 38 has been completely removed from the second capacitor 15.

Given toner marks that have not been inked over their entire surfaces, for example that exhibit multiple band-shaped inked regions arranged in parallel, the average layer thickness of the toner mark 39 that would be generated given a uniform distribution of the toner particle quantity used to ink the toner image that is not inked over its entire surface can be determined with the aid of the measurement arrangement 10.

The average inking of a toner mark or a measurement signal that corresponds to the average inking of a toner mark that is not inked over its entire surface can be determined simply with the aid of the measurement arrangement 10. If the layer thickness with which the toner image that is not inked over its entire surface is inked is additionally known, the areal coverage of this toner mark not inked over its entire surface can be determined in a simple manner based on the determined layer thickness of the toner mark not inked over its entire surface.

For this the layer thickness can be determined in various ways; in particular it can be measured. A toner mark inked over its entire surface is advantageously detected with the aid of the arrangement according to FIG. 1*a*, wherein the different change of the capacitances of the capacitors 13, 15 due to the toner mark inked over its entire surface and due to the toner mark not inked over its entire surface indicates the areal coverage of the toner mark not inked over its entire surface. This is possible in that the inked regions of the toner mark inked over its entire surface and of the toner mark not inked over its entire surface have the same layer thickness of the toner particle layer used for inking.

Figure 2:
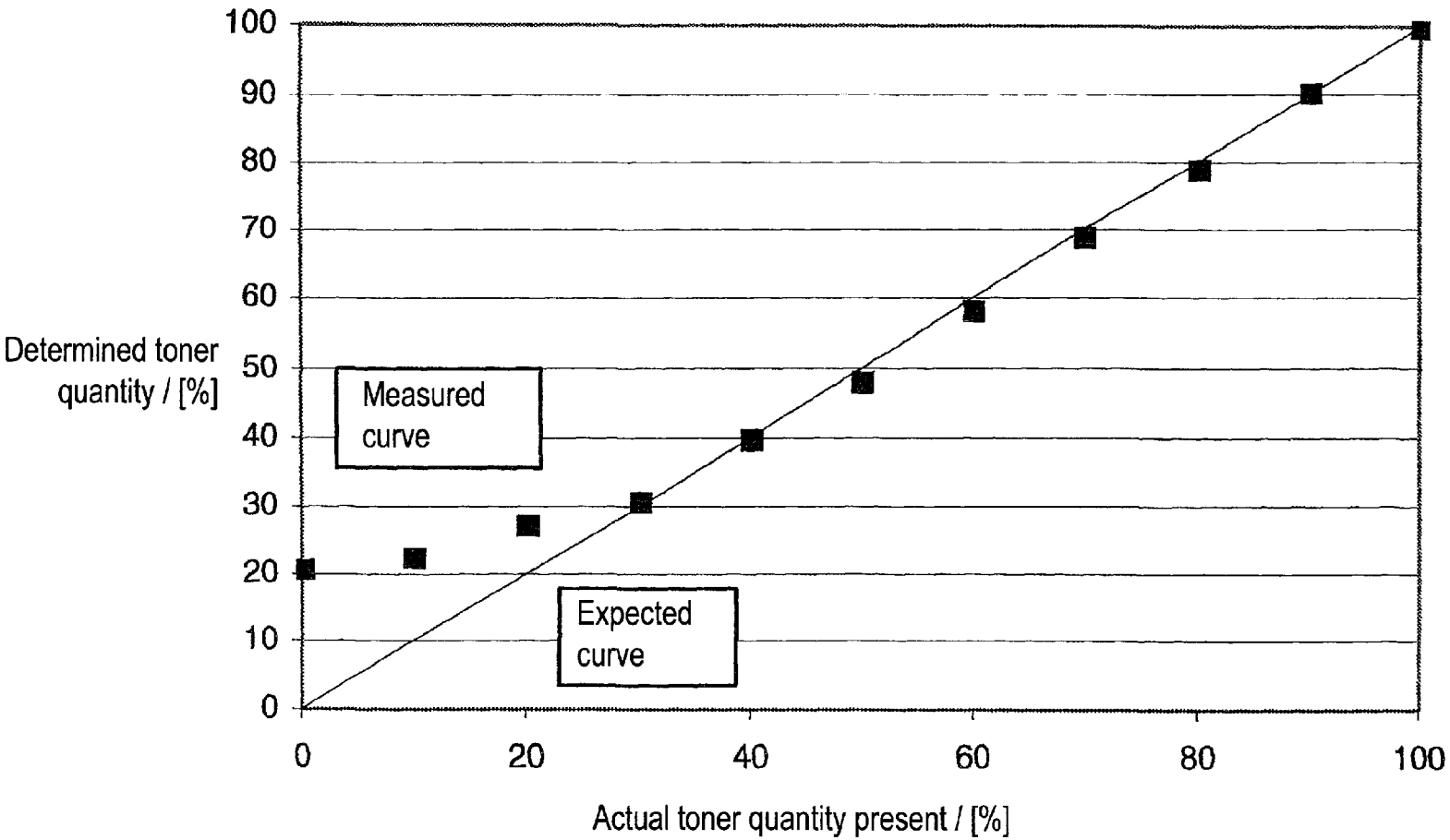
FIG. 2 is a diagram with the relationship of the actual toner quantity and the toner quantity of the toner mark determined with the aid of the measurement arrangement according to FIG. 1*a;*

A diagram with a characteristic line (formed from individual test points) of the measurement arrangement 10 according to FIG. 1*a* with conventional measurement value processing is shown in FIG. 2. The individual test points are shown as squares in the diagram according to FIG. 2. The characteristic line indicated by the squares indicates the ratio of the actual present toner quantity and the toner quantity determined by the measurement arrangement 10 with downstream signal evaluation. The ideal characteristic line of the measurement arrangement 10 is shown as a straight line in FIG. 2. In the diagram according to FIG. 2, the actual present toner quantity of the toner mark 39 is indicated on the x-axis, and the toner quantity determined with the aid of the measurement arrangement 16 and the conventional measurement value processing is indicated on the y-axis.

The maximum detectable toner quantity is respectively 100%. The toner quantity is determined with the aid of the measurement arrangement 10 via the determination of the average layer thickness of the toner mark 39 located in the region of the capacitors 13 and/or 15. The toner quantity of 100% that is indicated in the diagram according to FIG. 2 is achieved via the layer thickness of the toner particle layer that is generated with the aid of the image generation process at the work point given a toner mark inked with toner particles over its entire surface. The region of ≦100% toner quantity is advantageously achieved via toner marks 39 not inked over their entire surfaces. In order to be able to ensure a high quality of the image generation process, however, it is necessary to also correctly detect toner marks with low toner quantities or low areal coverages and low optical densities.

Figure 3:
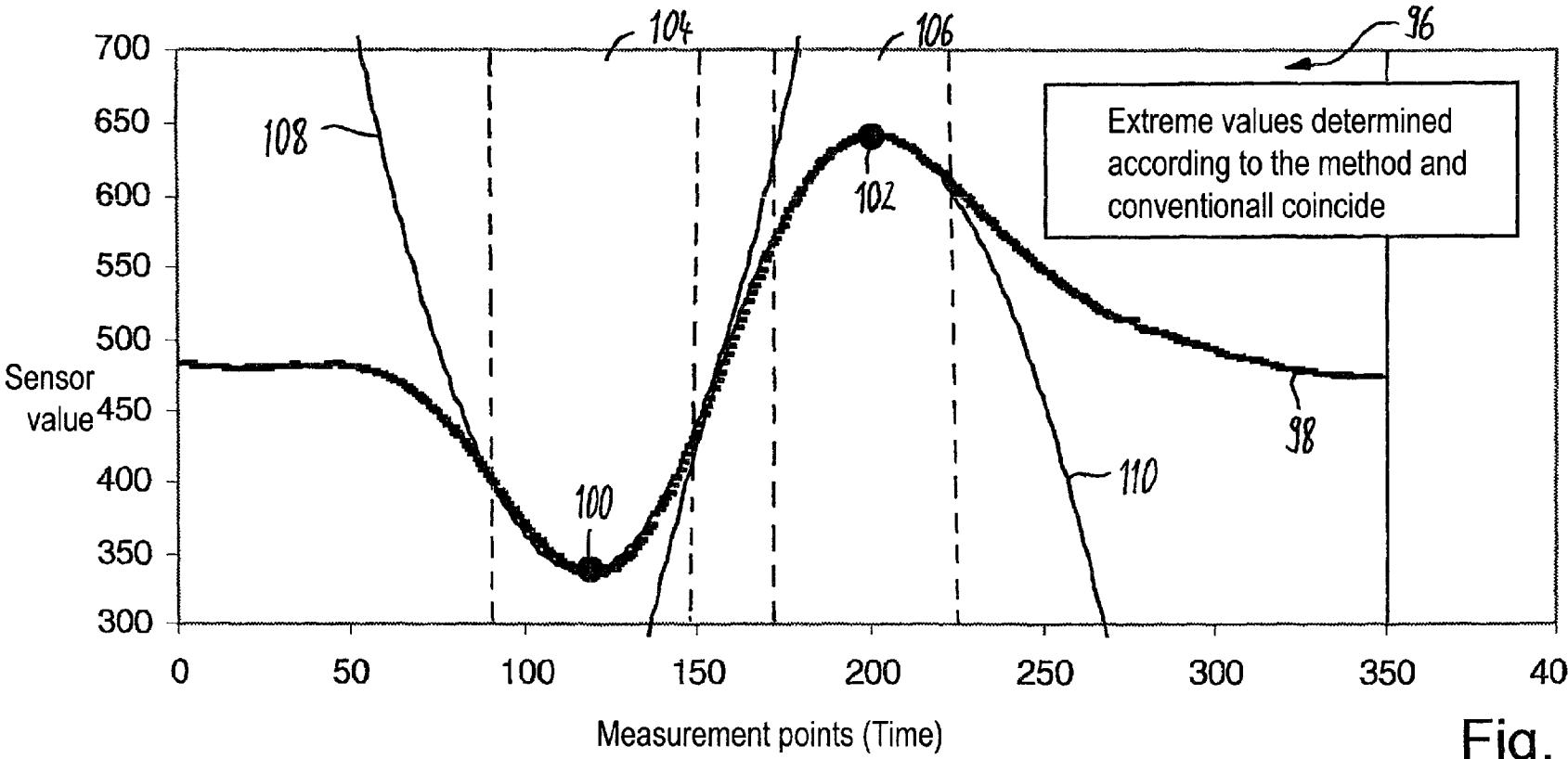
FIG. 3 is a diagram with the actual determined signal curve of the sample values output by the measurement arrangement according to FIG. 1*a* in a relevant sample time period upon sampling a toner mark inked over its entire surface with a standard toner of the color black, depending on the time.

A diagram in which the actual signal curve 98 is shown in an outer measurement window 96 of approximately 350 sample values detected with the aid of the measurement arrangement 10 is shown in FIG. 3. This outer measurement window 96 thereby indicates the time range in which the sample values are detected and/or additionally processed with the aid of the measurement arrangement 10. Due to the constructive design of the measurement arrangement 10, the signal curve 98 formed by the sample values has a minimum 100 and a maximum 102. The order of the minimum and of the maximum depends on, among other things, the feed direction of the toner mark 39, i.e. whether the toner mark is directed through the capacitors 13, 15 in the direction of the arrow P1 according to FIG. 1*a* or in the opposite direction. To determine the sample values shown in FIG. 3, the toner mark 39 has been supplied to the measurement arrangement 10 in the direction opposite the arrow P1 according to FIG. 1*a*, whereby the difference of the signal curves from FIG. 1*b* and FIG. 3 results. Furthermore, the order of minimum and maximum in the determined signal curve 98 can be changed by exchanging the voltage sources 42, 44. In FIG. 3, the minimum 100 and the maximum 102 are respectively shown as enlarged sample points. The difference of the determined minimum 100 and maximum 102 is advantageously calculated, wherein the absolute value of the difference is advantageously processed further. The difference in particular serves as a real value for an inking and/or point size regulation in an electrographic image generation process.

A first, inner measurement window 104 is also established. The sample values in this first inner measurement window 104 are processed further with the aid of an evaluation unit, wherein a first function whose graph is designated with the reference character 108 in FIG. 3 is determined on the basis of these sample values in the measurement window 104. The determination of this first function can occur with the aid of a compensation calculation or via approximation. In particular what are known as least square methods or a regression calculation can thereby be applied. In particular, a polynomial regression calculation can be used. A polynomial is advantageously determined as a function. The first function of the graph 108 according to FIG. 3 can be sufficiently precisely described by a second order polynomial, for example. The minimum 100 is then determined from the first function. Measurement values distorted by perturbations, in particular individual sample values smaller than the minimum value 100, can thereby remain unconsidered and/or cannot or can only slightly distort the measurement result.

A second function whose graph is designated with the reference character 110 in FIG. 3 is determined with the aid of the sample values located in a second inner measurement window 106. The maximum value 102 is determined from this second function, whereby individual, incorrect sample values can remain unconsidered and/or not or only slightly distort the measurement result. The minimal value 100 determined from the first function and the maximum value 102 determined from the second function are processed further, wherein in particular the difference between the minimum value 100 and the maximum value 102 is determined and used as a real value for a full-tone inking and/or point size regulation.

Figure 4:
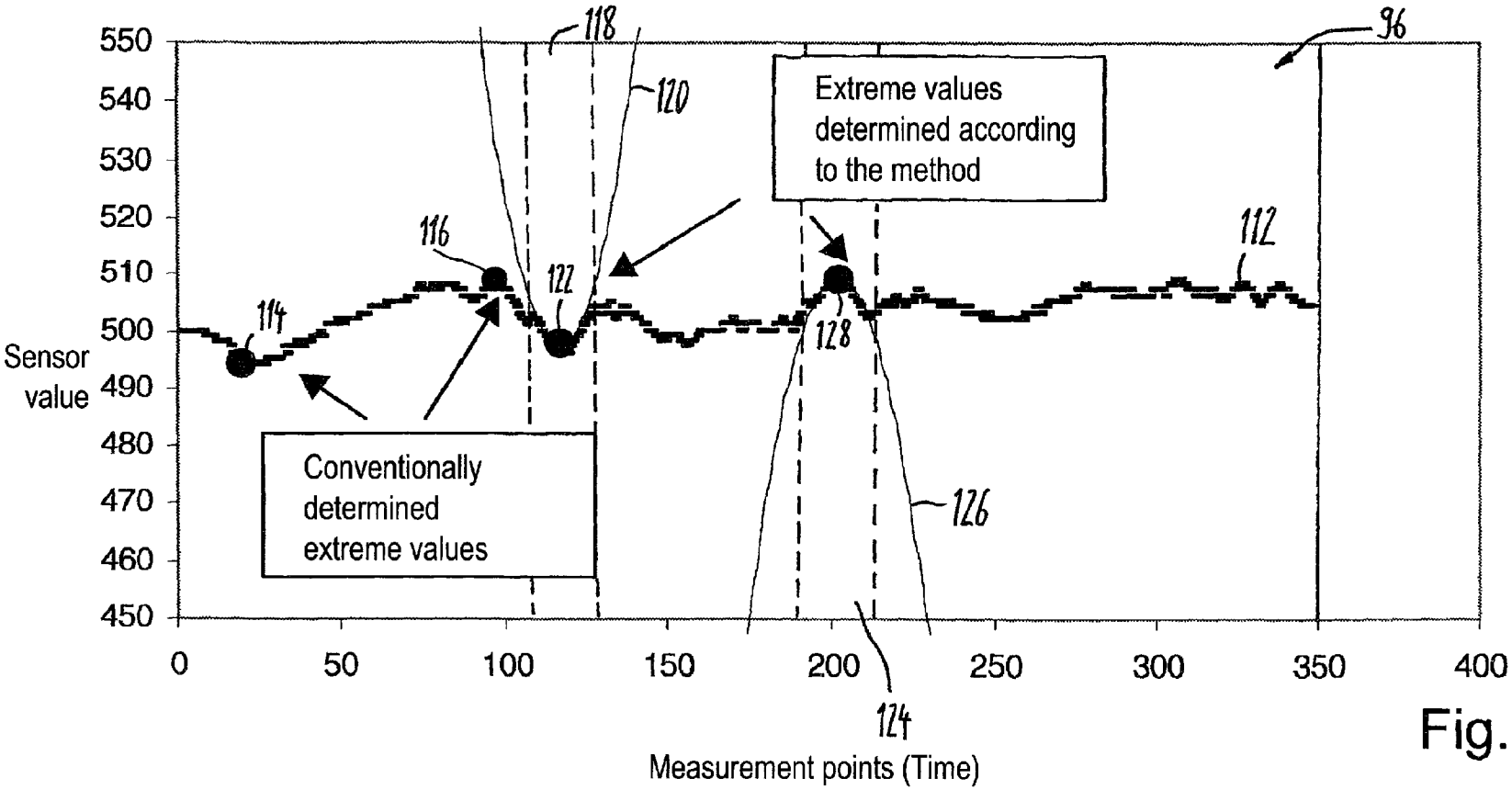
FIG. 4 is a diagram with the signal curve of the sample values output by the measurement arrangement according to FIG. 1*a* in a relevant sample time period upon sampling a toner mark that is not inked over its entire surface with a customer-specific special color, depending on the time, wherein the toner particles of the special color exhibit a low relative permittivity.

The diagram according to FIG. 3 is shown in FIG. 4 with a signal curve 112 formed from the sample values determined by the measurement arrangement 10 upon sampling an additional toner mark. This additional toner mark is a toner mark not inked over its entire surface, which toner mark is, for example, inked with a toner whose toner particles have a low relative permittivity. Such a toner mark produces a low measurement signal. Due to the low measurement signal, perturbations strongly affect the determined signal curve 112.

These perturbations can in particular be thermal perturbations and/or electromagnetic perturbations.

If the first (or the lowest) minimum value and the first (or the highest) maximum value is determined by a conventional evaluation unit (not an evaluation unit according to the preferred embodiment) to evaluate the signal curve 112, the sample values 114 and 116 are determined as minimum value and maximum value. However, these sample values have not been produced by the detection of the additional toner marks but rather via perturbations. If these sample values 114 and 116 are processed further as a measurement result and used to control or regulate an image generation process, this leads to an incorrect adjustment of the image generation process.

In order to determine the minimum value produced by the additional toner mark, a first inner measurement window 118 is provided. A first function whose function curve is shown as Graph 120 in FIG. 4 is determined via approximation with the aid of the sample values in the first inner measurement window 118. The extreme value or the peak value (and thus minimum value 122) is determined from this first function. A second inner measurement window 124 is provided to determine the maximum value produced by the toner quantity, wherein a second function whose function curve is shown as Graph 126 is determined with the aid of the sample values in the second inner measurement window 124. The extreme value or peak value (and thus the maximum value 128) of this second function is determined. The minimum value 122 and the maximum value 128 are processed further and used to control or regulate the image generation process. Even given low sensor signals with a low amplitude spectrum and relatively large perturbations, it can thus be ensured that a minimum value 122 suitable for further processing and control of the image generation process and a maximum value 128 suitable for further processing and control of the image generation process are determined, and that a different (in particular smaller) minimum value 114 or a different (in particular larger) maximum value 116 are incorrectly determined. These false minimum and maximum values would lead to an incorrect control or regulation of the image generation process. The actual curve of the sample values in the region of the minimum 122 produced by the toner mark and in the region of the maximum 128 produced by the toner mark is simulated with the aid of the functions 120, 126. Signal deviations of individual measurement values and what is known as signal noise thereby have only a slight influence on the determined minimum 122 and the determined maximum 128. The functions of the graphs 120 and 126 are advantageously approximated (with the aid of a second order polynomial) to the signal curve of the determined sample values in the measurement window ranges 118 and 124. In particular a method for polynomial regression is thereby used. Correct measurement results can thereby be correctly determined even for toner marks with very low toner masses or with low areal coverages, as well as for toner marks with toner particles that have a low relative permittivity. This is possible even when what is known as the signal noise of the measurement signal determined with the aid of the measurement arrangement 10 has a greater variance than the signal change of the measurement signal 112 that is produced by the toner mark. As shown in FIG. 4, correct extreme values can be determined via the described procedure even for toner marks with lower areal coverage and for toner marks with toner particles that have a low relative permittivity.

Given the use of the polynomial regression for processing the sample values output by the measurement arrangement 10, the sample values determined in the measurement windows 118 and 124 are respectively extracted and processed further as vectors. The sample values are thereby associated with the variables $Yin_{Minimum}$, wherein the sequential numbering of the determined sample values is associated with the variable X. The sample values determined as measurement values in the measurement window 118 are associated with the variables Y as follows:

$$Yin_{Minimum}[1] = \text{measurement values}[Start_{Min}];$$

$$Yin_{Minimum}[2] = \text{measurement values}[Start_{Min} + 1];$$

$$Yin_{Minimum}[3] = \text{measurement values}[Start_{Min} + 2];$$

$$\vdots$$

$$Yin_{Minimum}[Number_{Min}] = \text{measurement values}[Number_{Min}];$$

The following progression of value pairs of the determined sample values thereby results:

| | Xin | | | | |
|---|---|---|---|---|---|
| | 1 | 2 | 3 | . . . | $Number_{Min}$ |
| $Yin_{Minimum}$ | Measurement value [$Start_{Min}$] | Measurement value [$Start_{Min}$ + 1] | Measurement value [$Start_{Min}$ + 2] | . . . | Measurement value [$Number_{Min}$] |

Starting from the determined value pairs, the following normal equation system is set up for polynomial regression:

$$A\cdot\vec{a}=\vec{c}$$

with $$A_{jk}=A_{kj}=\Sigma x_i^{j+k-2}$$

$$c_k=\Sigma x_i^{k-1}\cdot y_i$$

follows $$\vec{a}=A^{-1}\cdot\vec{c}$$

The multiplication of the inverse matrix A (Matrix $A^{-1}$) with the vector c yields a coefficient matrix a. This coefficient matrix contains the coefficient values for a polynomial that specifies the first function 122 of the graph 120. The minimum 122 can be determined in a simple manner with the aid of the polynomial.

For this the coefficient values determined by the coefficient matrix are used in the following function:

$$y=a_1\cdot x^2+a_2x+a_3$$

If the first derivation of this (first) function is set equal to zero, a peak point of the function (and thus the minimum 122 or a maximum) can be determined in a simple manner.

The sample values of the variables Y that are determined in the second inner measurement window 124 are associated as follows (in the same manner as for the sample values determined in the first inner measurement window 118):

$$Yin_{Maximum}[1] = \text{measurement values}[Start_{Max}];$$

$$Yin_{Maximum}[2] = \text{measurement values}[Start_{Max} + 1];$$

$$Yin_{Maximum}[3] = \text{measurement values}[Start_{Max} + 2];$$

$$\vdots$$

$$Yin_{Maximum}[Number_{Max}] = \text{measurement values}[Number_{Max}];$$

The following value pairs thereby result for the sample values determined in the measurement window 124:

| | Xin | | | | |
|---|---|---|---|---|---|
| | 1 | 2 | 3 | ... | $Number_{Max}$ |
| $Yin_{Maximum}$ | Measurement value [$Start_{Max}$] | Measurement value [$Start_{Max}$ + 1] | Measurement value [$Start_{Max}$ + 2] | ... | Measurement value [$Number_{Max}$] |

Starting from the determined value pairs, the normal equation system that has already been explained and used to determine the first function is used for polynomial regression:

The coefficient matrix $\vec{a}$ is determined with the aid of this procedure. The coefficient values are used in the function $$y=a_1 \cdot x^2+a_2x+a_3$$

The first derivation of this (second) function is calculated and set equal to zero so that a peak point of the function (and thus the maximum 128) of the second function can be determined in a simple manner.

Alternatively, the extreme values 122, 128 can be determined by the calculation of the first derivation but rather are calculated via the use of different X values, wherein the smallest or largest Y value of the respective function $$y=a_1 \cdot x^2+a_2x+a_3$$

is determined and used as a corresponding extreme value. A lesser or greater computing capacity is demanded in this procedure relative to the calculation of the first derivation, depending on the degree of the polynomial.

With the aid of the described procedure, even toner marks that are not inked over their entire surfaces that have a toner quantity ≦30%, and given toner particles that have a low relative permittivity, can be determined in a simple manner. No hardware changes are required for realization of the procedure according to the invention in known high-capacity printers, rather merely a software expanded with this evaluation function.

Figure 5:
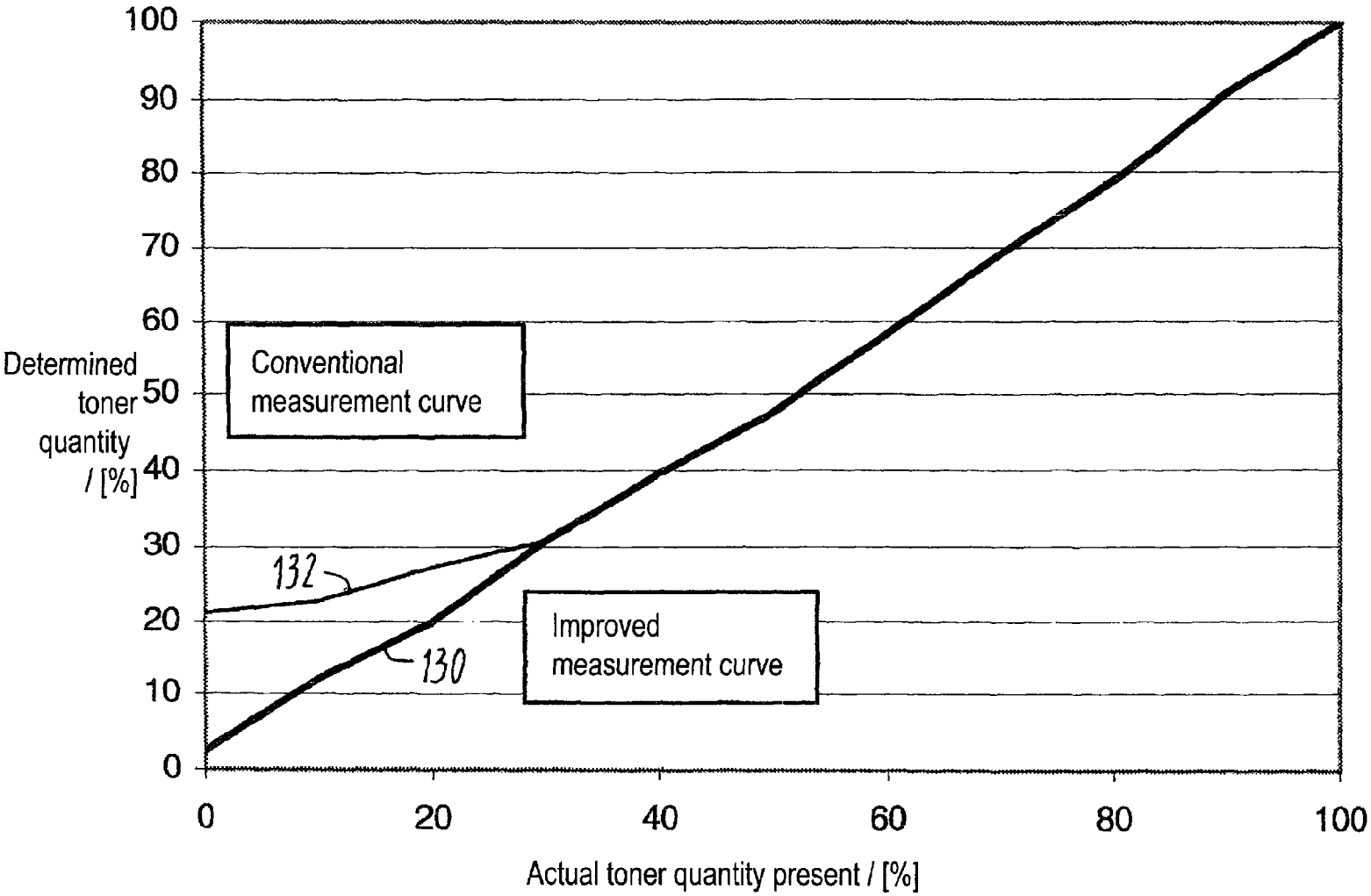
FIG. 5 is a diagram in which the measurement results of a conventional measurement value processing and an improved measurement value processing are juxtaposed.

The measurement value curve as Graph 130 as improved by the described procedure and the conventional curve as Graph 132 are shown in FIG. 5. From this presentation it is clear that a correct detection of toner marks that have only a small toner quantity and possibly have toner particles with a low relative permittivity is possible with the aid of the described procedure.

The polynomial regression can respectively be implemented for a fixed number of determined sample values, wherein not every sample value output by the measurement arrangement 10 must be taken into account in the polynomial regression. The advantage of this procedure is that a relatively small computing capacity is sufficient to implement this polynomial regression. The fixed number of sample values drawn upon for the polynomial regression is possible via the establishment of suitable measurement windows 104, 106, 118, 124 in a simple manner.

Alternatively or additionally, a polynomial regression can also be implemented for a variable number of sample values, which can be flexibly taken into account even given changing print speeds and various types of toner mark geometries as well as different pre-processings of the measurement signal output by the measurement arrangement 10.

It is possible to limit the measurement windows 104, 106, 118, 124 in which a minimum value 122; 100 or a maximum value 124; 102 is expected relatively precisely based on the workflows of the image generation process; small measurement windows 118, 124 to determine a suitable function/suitable functions; and assuming the determined function/the determined functions, the extreme values (minimum/maximum) can be determined relatively precisely with low computing capacity. In particular, the measurement windows 104, 106 and 118, 128 have different sizes.

It is also possible to establish the position and/or size of the measurement window depending on: the degree of inking to be expected due to the print data for generation of the respective toner mark; the areal coverage to be expected due to the print data for generation of the respective toner mark; and/or toner properties of the toner particles used to generate the toner mark, in particular the toner color and/or the relative permittivity of the toner particles.

A temporal limitation of the regions 118, 124; 104, 106 in which an extreme value 122, 128; 100, 102 is expected can also occur via the detection of a plurality of toner marks, whereby what is known as a self-learning process is produced. The time range in which a minimum 122; 100 and a maximum 128; 102 is expected can also be determined and/or limited with the aid of additional toner marks. The additional toner marks can in particular be toner marks that can regularly be generated to monitor and control the image generation process and can additionally be drawn upon for the purposes of calibrating the measurement windows 104, 106, 118, 124. All toner marks in the revolution direction of the photoconductor belt 16 advantageously have the same toner mark length, and advantageously have a width greater than the width detectable with the aid of the measurement arrangement 10. Given such toner marks, the points in time of the minimum 100 and the maximum 102 of toner marks inked over their entire surfaces coincide with the minimum 122 and the maximum 128 of toner marks with a lower areal coverage and/or with other properties of the toner particles.

As an alternative to the second order polynomial, a polynomial can also be determined that specifies the entire signal curve 98, 112 or a greater section of the respective signal curve 98, 112 in order to then determine extreme values in the relevant regions 118, 124.

Alternatively, a function/the functions can also be determined in another suitable manner.

As an alternative or in addition to the toner quantity, the toner mass of the toner mark (advantageously relative to an area) can be detected or determined with the aid of the measurement arrangement 10 and/or the evaluation unit 24.

The preferred embodiment can advantageously be used in electrographic printing or copying devices whose recording methods for image generation are in particular based on the electrophotographic, magnetographic or ionographic recording principle. The printing or copying devices can also use a recording method for image generation in which an image recording medium is directly or indirectly electrically activated point-by-point. However, the preferred embodiment is not limited to such electrographic printing or copying devices.

Although preferred exemplary embodiments are shown and described in detail in the drawings and in the preceding specification, these should be viewed purely as examples and not as limiting the invention. It is noted that only preferred exemplary embodiments are presented and described, and all variations and modifications that presently and in the future lie within the protective scope of the invention should be protected.

We claim as our invention:

1. A method for processing a measurement signal to determine a toner quantity of a toner mark, comprising the steps of:

generating the toner mark with aid of an image generation device;

detecting the toner mark with aid of a measurement unit in that sample values determined by the measurement unit at sample points in time are output as said measurement signal for determining said toner quantity of said toner mark; and for determining said toner quantity determining a function to describe at least one part of a signal curve of the measurement signal on the basis of at least one part of the output sample values, and determining at least one extreme value of the function, and wherein the function is determined for a time period in which said extreme value is expected due to the toner mark supplied to the measurement unit, the time period being bounded by a measurement window in which said expected extreme value will lie within, and the function being determined on the basis of the sample values output by the measurement unit in the time period.

2. A method according to claim 1 wherein:

a second extreme value of the function is determined;

the first extreme value is a maximum value of the function and the second extreme value is a minimum value of the function, or the first extreme value is a minimum value of the function and the second extreme value is a maximum value of the function; and a difference value between the maximum value and the minimum value is determined and further processed as a measurement result.

3. A method according to claim 1 wherein:

at least one second extreme value is determined with aid of the sample values output as said measurement signal by the measurement unit;

an additional function to describe a continuous signal curve of the measurement signal is determined on the basis of at least one additional part of the output sample values;

at least one additional extreme value of the additional function is determined;

the first extreme value is a maximum value of the function and the second extreme value is a minimum value of the additional function, or the first extreme value is a minimum value of the function and the second extreme value is a maximum value of the additional function; and a difference value between the two extreme values is determined and further processed as a measurement result.

4. A method according to claim 1 wherein the sample values serve as nodes in the determination of the function, and the function describes a curve of an assumed, continuous signal curve of the detected property in a range of the extreme value due to effects of the toner mark on the measurement unit.

5. A method according to claim 1 wherein the function is determined with aid of a compensation calculation.

6. A method according to claim 1 wherein an n-th order polynomial is determined as the function.

7. A method according to claim 1 wherein the sample values are filtered with aid of a filter, the function being determined with aid of the filtered sample values output by the filter.

8. A method according to claim 1 wherein multiple toner marks generated in succession with aid of the image generation device are detected with aid of the measurement unit during a respective measurement window, wherein the measurement unit respectively outputs the sample values, a corrected sample value sequence is generated with aid of the detected sample values, and the function is determined with aid of the corrected sample value sequence.

9. A method according to claim 1 wherein the measurement signal is determined with aid of a capacitive sensor of the measurement unit that has two capacitors formed by electrodes and arranged in series in a revolution direction of an image substrate bearing the toner mark, the capacitors are charged with opposite charge voltages relative to a reference potential in order to charge the capacitors, and the capacitors are electrically connected after a charging procedure and a charge difference is thereby generated that is a measure of a capacitance difference of the two capacitors as a result of the positioning of the toner mark in an air gap of at least one of the capacitors.

10. A system to determine a measurement signal to determine a toner quantity of a toner mark, comprising:

an image generation unit that generates at least one toner mark;

a measurement unit that samples the toner mark and outputs sample values determined at sample points in time as a measurement signal to determine said toner quantity of said toner mark; and a control unit for determining said toner quantity by determining a function to describe at least one part of a signal curve of the measurement signal on a basis of at least one part of the output sample values, and that determines at least one extreme value of the function, and wherein the function is determined for a time period in which said extreme value is expected due to the toner mark supplied to the measurement unit, the time period being bounded by a measurement window in which said expected extreme value will lie within, and the function being determined on the basis of the sample values output by the measurement unit in the time period.

11. A method for processing a measurement signal to determine a property of a toner mark, comprising the steps of:

generating the toner mark with aid of an image generation device;

detecting the toner mark with aid of a measurement unit in that sample values determined by the measurement unit at sample points in time are output as said measurement signal for determining a toner quantity of said toner mark; and for determining said toner quantity determining a function to describe at least one part of a signal curve of the measurement signal on the basis of at least one part of the output sample values, and wherein said measurement unit comprises two capacitors, the capacitors being charged with opposite charge voltages relative to a reference potential, and electrically connecting after a charging procedure the two capacitors to provide a charge difference as a measure of a capacitance difference of the two capacitors as a result of the positioning of the toner mark in an air gap of at least one of the two capacitors, and determining at least one extreme value of the function, and the function being determined for a time period in which said extreme value is expected due to the toner mark supplied to the measurement unit, the time period being bounded by a measurement window in which said expected extreme value will lie within, and the function being determined on the basis of the sample values output by the measurement unit in the time period.

* * * * *